United States Patent [19]

Kopfer

[11] 3,995,647

[45] Dec. 7, 1976

[54] COMBINED MIXER AND APPLICATOR DEVICE

[76] Inventor: Rudolph J. Kopfer, 1321 S. Eliseo Drive, Greenbrae, Calif. 94904

[22] Filed: Sept. 25, 1975

[21] Appl. No.: 616,771

[52] U.S. Cl. ..... 132/74.5

[51] Int. Cl.[2] ..... A45D 29/18

[58] Field of Search ..... 132/74.5, 88.5, 88.7; 128/278, 276, 280–282, 302, 218, 231, 257; 401/213, 245–247, 202

[56] References Cited

UNITED STATES PATENTS

| | | | |
|---|---|---|---|
| 2,512,100 | 6/1950 | Haber | 132/74.5 |
| 3,330,281 | 7/1967 | Visser | 128/218 M |
| 3,786,820 | 1/1974 | Kopfer | 132/74.5 |

FOREIGN PATENTS OR APPLICATIONS

| | | | |
|---|---|---|---|
| 1,020,769 | 11/1952 | France | 401/213 |
| 817,414 | 10/1951 | Germany | 401/213 |

*Primary Examiner*—G.E. McNeill
*Attorney, Agent, or Firm*—George B. White

[57] ABSTRACT

A tubular container and an applicator of the dropper type extended through one end thereof and spaced from the walls of the container; a sealing gland on the other end of the container; a sealing element in the middle of the inner portion of the gland tightly engaging the tip of the applicator thereby to seal the same; the applicator is press fit in the end of the container and has a stem provided with resiliently collapsible element such as a bulb; one component of the proposed mixture being inside the applicator and the other component of the mixture is between the outer container and the applicator properly separated until such time that the applicator is withdrawn to a distance equal to the depth of the sealing pocket thereby freeing the tip and permitting the pumping of the contents of the applicator into the component in the outer container whereupon the applicator is used for mixing the two components and after mixing them, the mixture can be sucked into the applicator and then suitably dispensed.

9 Claims, 4 Drawing Figures

COMBINED MIXER AND APPLICATOR DEVICE

BACKGROUND OF THE INVENTION

In previous devices for the same purpose, such as in U.S. Pat. No. 3,786,820 granted to Rudolf J. Kopfer, reliance is had on a frangible container within another container and devices to break the frangible container to accomplish the mixture. The primary object of this invention is to provide a combination dispenser and mixer in which the components of the mixture are positively separated and sealed apart without the use of a frangible holder for one of the components and which can be made comparatively compact and simple both in structure and operation.

DETAILED DESCRIPTION

Figure 1:
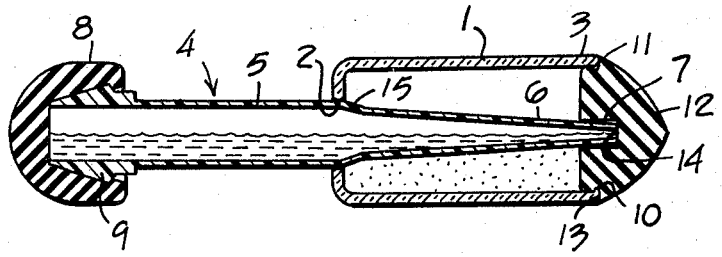
FIG. 1 is a longitudinal sectional view of the device.
Figure 2:
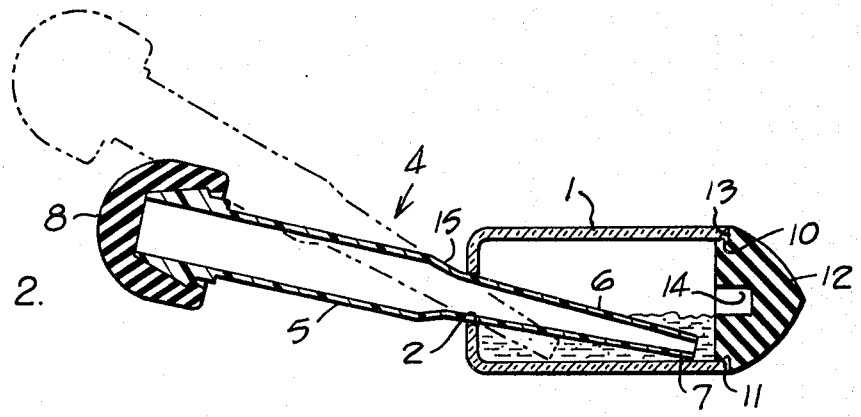
FIG. 2 shows the applicator withdrawn into mixing attitude.
Figure 3:
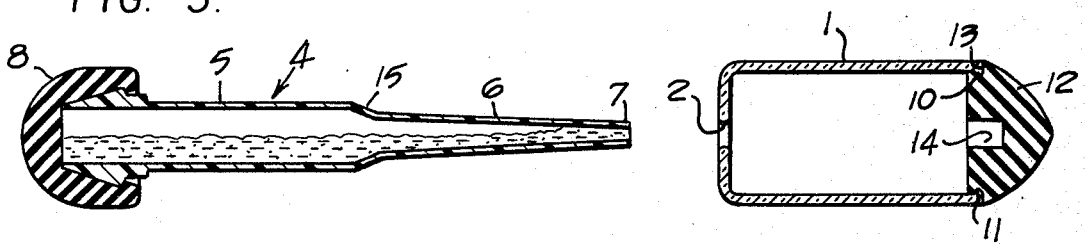
FIG. 3 shows the applicator completely withdrawn.

A tubular outer container 1 has a hole 2 in one end thereof and is open at its other end 3.

An applicator 4 of the dropper type is inserted through the hole 2. The applicator has a tubular stem 5 and a tapered dispenser portion 6 which latter terminates in a dispenser tip 7. The stem 5 is made of resiliently compressible material for tight sealing pressure engagement with the hole 2. On the outer end of the stem 5 is a bulb 8 which may be also resiliently compressible. For pumping material into and out of said applicator 4, the stem 5 is alternately compressed and released. The bulb 8 fits on a shouldered head 9 on the stem 5 so as to be removable for filling the applicator.

The other end 3 of the tubular container 1 has an inwardly projecting annular rib 10 which fits into an annular groove 11 of a sealing gland 12 made of resiliently compressible material so as to be tightly sprung over said rib 10. A shoulder 13 adjacent the groove 11 bears against the adjacent end of the container 1. A sealing pocket 14 in the part of the sealing gland 12 inside said container 1 is of a size to fit tightly, grip and seal the tip 7 of the applicator 4, thereby to prevent escape of the component from the applicator 4 until the applicator 4 is withdrawn far enough to clear the tip 7 from the pocket 14.

An illustrative use of this device is for a compound to repair finger nails. One component is a suitable liquid monomer and the other component is a suitable polymer usually in powder form. The applicator is inserted through the hole 2. The container is then loaded with the polymer, and the sealing gland 12 is pressed on the end 3 of the container, and thereby the pocket 14 is pressed on the tip 7 of the applicator 4. Finally the liquid monomer is poured into the applicator 4 and the bulb 8 is pressed on the head 9.

In use the applicator 4 is first withdrawn about a distance slightly more than the depth of the pocket 14 so as to clear the tip 7. Then by pressing the stem 5 the liquid monomer is expelled into the container 1. A tapered portion 15 between the stem 5 and the dispenser portion 6 near the hole 2 is provided, so that when the applicator 4 is withdrawn from the pocket 14 the tapered portion 15 is located in the hole 2, and the applictor 4 can be turned around the inside of the container 1 for mixing the liquid with the contents of the container 1. After thorough mixture is accomplished, the stem 5 is manipulated to suck the mixed compound into the applicator 4. Then the applicator 4 is completely withdrawn from the container 1 and the contents in the applicator 4 can be dispensed on the fingernail, or other object to be treated.

Figure 4:
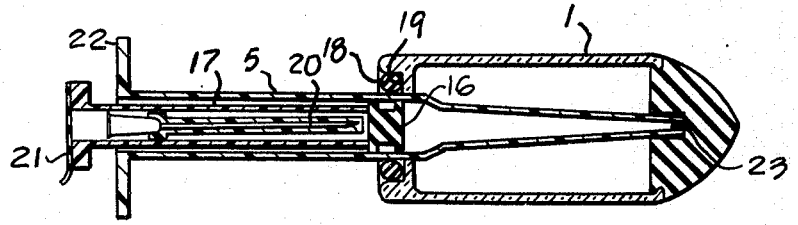
FIG. 4 is a sectional view of a modified applicator.

As shown in FIG. 4, the applicator is in the form of a syringe. In the stem 5 is a rubber plunger which has thereon a hollow connecting rod 17. On the exterior of the stem 5 is provided a ring seal 18 fitting into a sealing recess 19. A needle 20 is stored in the hollow connecting rod 17. A removeable sealing cover 21 seals the outer end of the chamber in the hollow connecting rod 17. The stem 5 has on its outer end a suitable cross-member 22 for the usual engagement by the fingers when the applicator is used as a syringe. In lieu of the sealing pocket heretofore described, the gland has a cylindrical projection 23 which extends inwardly and fits into the top of the applicator. The initial operation and the mixing operation are the same as heretofore described in connection with the first embodiment. After the components are mixed, the connecting rod 17 and rubber plunger 16 are pulled outward and the suction thus created draws the mixed compound into the applicator. Thereafter the sealing strip 21 is removed and the needle 20 is withdrawn from the hollow connecting rod 17 and placed on the tip of the applicator so that the compound can be injected through the needle 21.

I claim:

1. A mixer and dispenser for components of a mixture comprising an outer container an applicator extended through a first end into and being spaced from the outer container to form a space around the applicator for a compound, said applicator having an open end inside said container, a sealing gland at the other end of said container, means in said gland engaged by said open end of the applicator for sealing said open end, said applicator having therein another component of said mixture, said applicator being releasably held in said first end of said container for withdrawal from said sealing means, and means on said applicator outside of said first end for expelling out of and sucking into said inner applicator components to be mixed and dispensed.

2. The invention specified in claim 1, and said means in said sealing gland for sealing the open end of said applicator being a pocket tightly fitting the open end of said dispenser.

3. The invention specified in claim 2, and wherein said expelling means is a resiliently compressible applicator stem outside of the end of the container from which said applicator extends.

4. The invention specified in claim 1, and separable means of connection between said sealing gland and the adjacent end of the outer container thereby to permit the insertion of the component into said container.

5. The invention specified in claim 1, and said applicator including a resiliently compressible sealing stem extending through said container, a reduced portion of said stem being so located relative to the adjacent end of said container as to be loosely moveable in said container when said applicator is withdrawn from said pocket, for mixing and dispensing.

6. The invention specified in claim 1, and said means for sealing the tip of said applicator being a projection fitting into the tip of the applicator.

7. The invention specified in claim 1, and said applicator including a stem extending through said end of said container, an applicator end extended from said stem to said sealing gland, said means for expelling out and sucking into said inner applicator components and mixture including a plunger in said stem a connecting element extended from said stem through the outer end of the stem being manipulatable for reciprocating said plunger.

8. The invention specified in claim 7, and the tip of said applicator being adapted to accommodate an injection needle.

9. The invention specified in claim 8, and means in said connecting element to store said needle.

* * * * *